United States Patent [19]

Wilkerson

[11] Patent Number: 5,018,729

[45] Date of Patent: May 28, 1991

[54] BATTING PRACTICE MACHINE

[76] Inventor: Cecil L. Wilkerson, 15 Alabama Ave., Phenix City, Ala. 36867

[21] Appl. No.: 403,160

[22] Filed: Sep. 5, 1989

[51] Int. Cl.[5] ..... A63B 69/40

[52] U.S. Cl. ..... 273/26 E; 273/29 A

[58] Field of Search ..... 273/26 E, 29 A

[56] References Cited

U.S. PATENT DOCUMENTS

| | | | |
|---|---|---|---|
| 2,058,277 | 10/1936 | Walther | 273/26 E |
| 2,134,328 | 10/1938 | Dickson | 273/26 E |
| 3,333,847 | 8/1967 | Pennington | 273/26 E |
| 3,408,070 | 10/1968 | Gonzales | 273/26 E |
| 3,637,208 | 1/1972 | Allred | 273/26 E |
| 3,885,790 | 5/1975 | Parr | 273/26 E |
| 4,555,110 | 11/1985 | Hai-Ping | 273/26 E |
| 4,647,042 | 3/1987 | Bruce | 273/26 E |
| 4,679,790 | 7/1987 | Ham | 273/26 E |
| 4,815,735 | 3/1989 | McClenny | 273/26 E |

FOREIGN PATENT DOCUMENTS

| | | | |
|---|---|---|---|
| 712035 | 6/1965 | Canada | 273/26 E |

*Primary Examiner*—Theatrice Brown

*Attorney, Agent, or Firm*—Michael C. Smith

[57] ABSTRACT

A batting practice machine comprising a generally flat horizontal base; a vertical frame; an adjustable, rotatable, outward extending arm; a line secured to the arm; a ball secured to the line; and a motor and drive mechanism for rotating the arm in a generally horizontal circle, thereby moving the ball along a horizontal circular path for repeated presentation to a batter.

4 Claims, 3 Drawing Sheets

BATTING PRACTICE MACHINE

TECHNICAL FIELD

The present invention relates generally to sports equipment, and specifically to baseball equipment, and more specifically to a batting practice machine.

BACKGROUND ART

Batting practice devices are well known in the art. Examples of ball throwing devices are shown in U.S. Pat. Nos. 4,709,685; 4,760,835; 4,712,534 and 4,774,928. Other ball delivery means are shown in U.S. Pat. Nos. 3,677,544; 4,538,810; 3,531,115 and 2,955,823.

While the varieties of ball throwing and ball delivery devices are well suited for their particular uses, until the present invention there has been no mechanical teathered ball rotational device for use in swinging a ball in a predetermined circle at a predetermined speed in a controlled manner to allow for frequent, repeated presentation of a ball to a batter in a selected path and speed. It is for this reason that the present batting practice machine was invented.

DISCLOSURE OF INVENTION

The present invention promotes batting skills by quickly, repeatedly presenting a teathered ball to a batter without the tedium and time usually required to fetch, gather and pitch balls. The present invention is a batting practice machine having a ball secured to the end of a line which is swung by an arm which rotates in an essentially horizontal manner. Arm height and angularity are adjustable, as is the speed of rotation.

Thus, a primary object of the present invention is to promote batting skills by providing mechanical means for moving a ball along a substantially circular path.

Another major object of this invention is to provide such a mechanism with means for adjusting the path and the speed of the ball.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with the accompanied drawings in which like parts are given like identification numerals and wherein:

BEST MODE FOR CARRYING OUT THE INVENTION

While there are many ways of presenting a ball to a batter, the method used in connection with the present invention is called the circular presentation method. This method is illustrated in FIG. 1.

Figure 1:
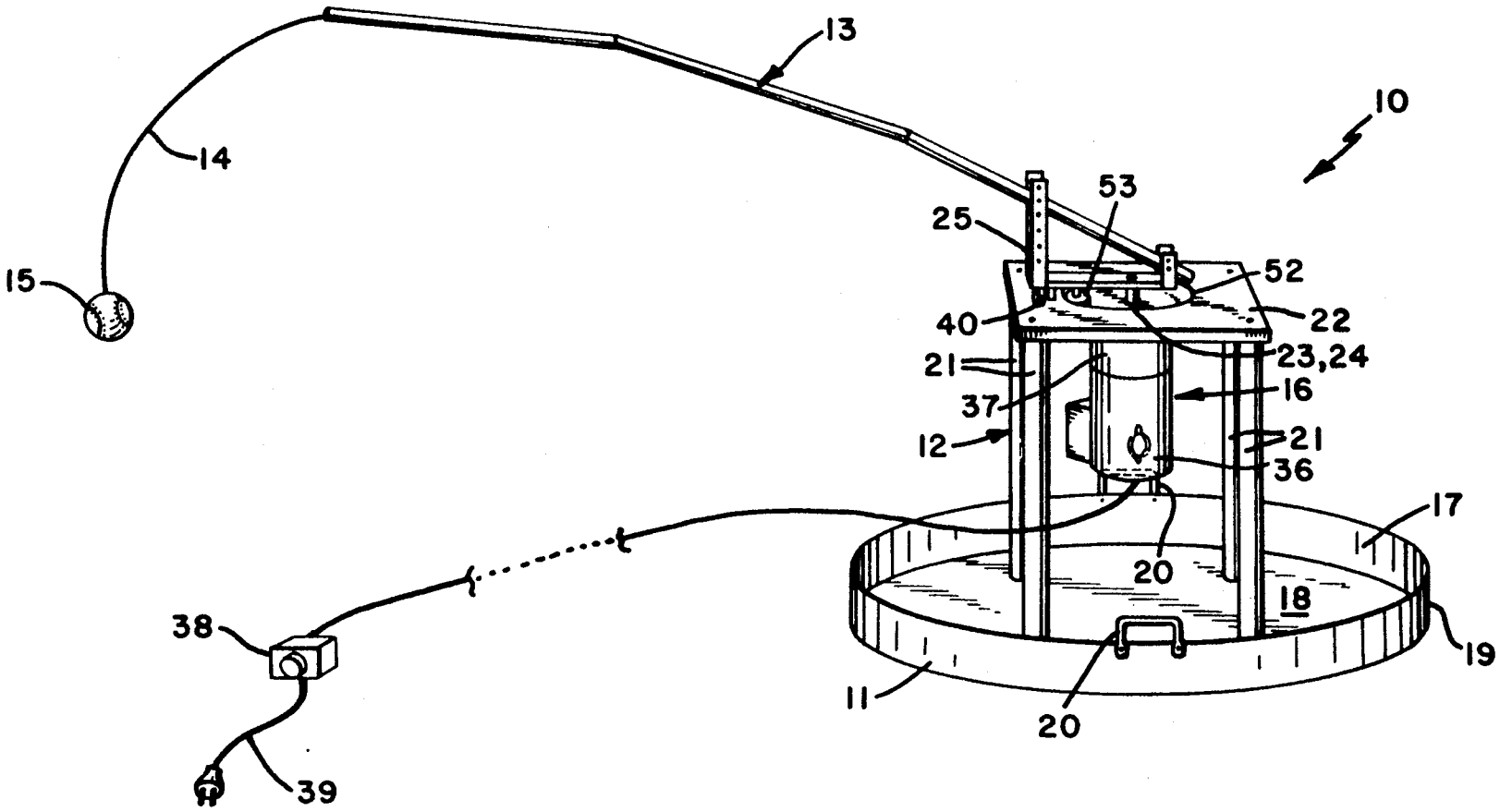
FIG. 1 is a perspective view of the invention.

As FIG. 1 of the drawing illustrates, the preferred embodiment of the present batting practice machine 10 comprises a generally flat base 11, a vertical frame 12, a swinging arm 13, a line 14, a ball 15, and a drive means 16. Base 11 comprises a reservoir 17 having a generally flat bottom, 18 and a peripheral wall 19 about 2 inches high. The base may have various silhouette shapes as seen from the top or bottom, but the preferred shape is a square, or a circle. One or more handles 20 may be secured to the base 11, and the frame 12 is secured to the base 11 at its center. Base 11 and frame 12 are made of rigid durable material such as plastic or metal, and the base 11 and frame 12 may be molded as a single piece. The reservoir 17 is about two inches deep and about 24 inches wide, providing a cavity of from about 1000 cubic inches to about 1200 cubic inches which will hold about 50 pounds of material such as sand or dirt, which will stabilize the machine 10 during rotary operation. It is preferable to mix a 50 lb. sack of quick concrete with water which substantially fills the reservoir 17 to provide a more permanent weight for the machine 10 when the mixture sets.

Figure 2:
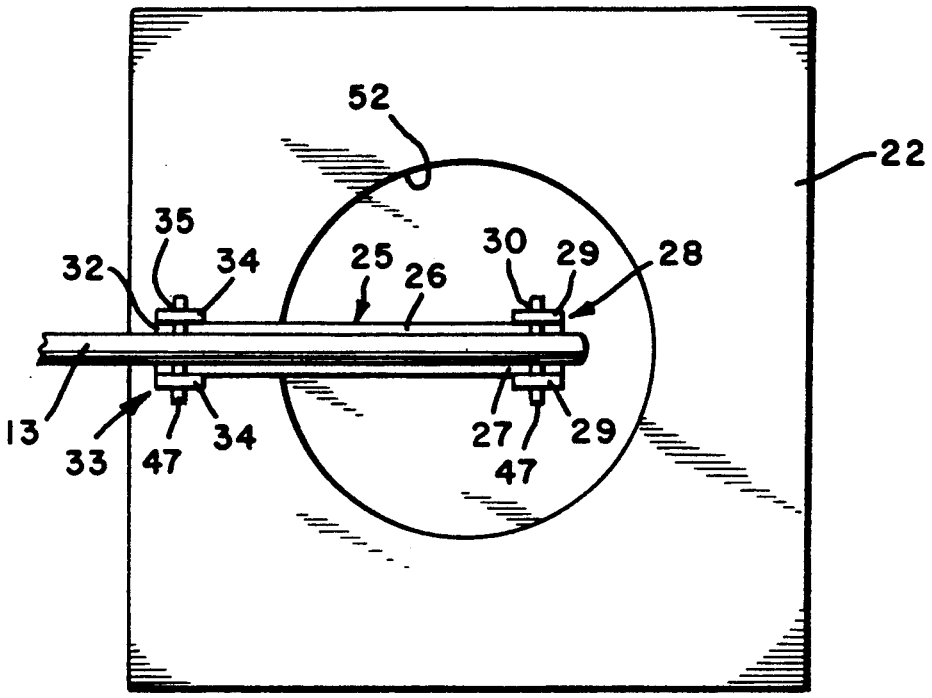
FIG. 2 is a top view of portions of the invention.
Figure 3:
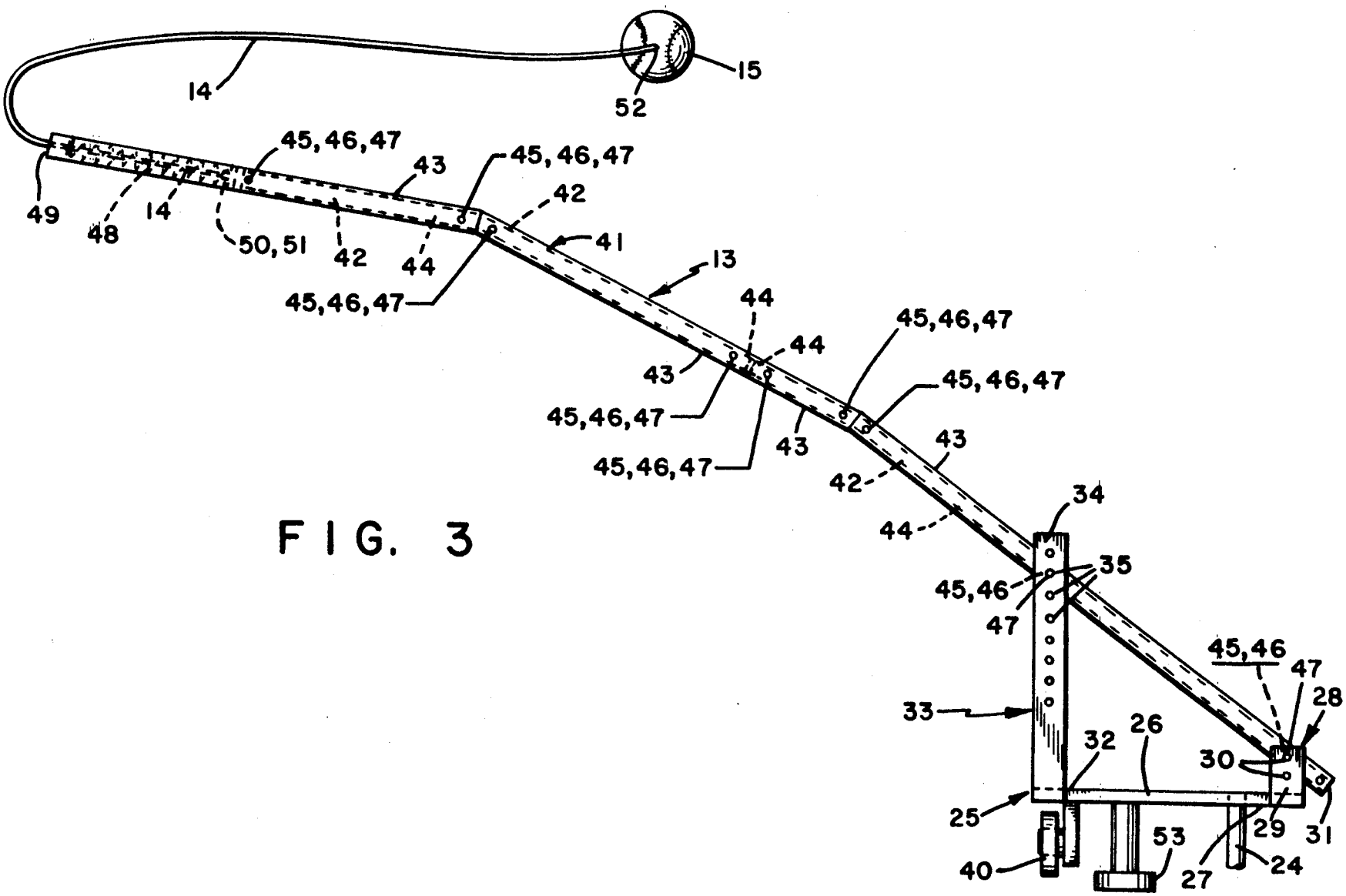
FIG. 3 is a detailed view of the arm and bracket of the invention.

Frame 12 comprises four vertical legs 21 which are about 12 inches in length and about one inch in width. They are secured generally perpendicular to bottom 18, generally near the center of base 11. Legs 21 are rigid and support a rigid, square drive plate 22 parallel to base 11. Drive plate 22 is also of a rigid material such as metal or plastic, and the plate 22 with the legs 21 form the frame 12. Drive plate 22 has an aperture 23 at its center, through which drive shaft 24 extends from below the plate 22, up to a rotatable arm bracket 25. As FIG. 2 and FIG. 3 show in closer detail, bracket 25 has a generally horizontal elongated beam 26 connected to the top of shaft 24 with about 1.50 inches of the beam 26 extending in one direction (the short end) and about 4.75 inches of the beam extending in the opposite direction (the long end). Atop the short end 27 of beam 26 is affixed a short yoke 28. Short yoke 28 comprises a pair of upward extending flanges 29 which are parallel, are separated by the width of the beam 26 of about 0.50 inch, and extend upward about 1.375 inches. A pair of horizontal apertures 30 are inscribed in each flange 29 of the yoke 28, providing a lower horizontal straight path through flanges 29 and an upper horizontal straight path through flanges 29. These apertures 30 provide adjustable points for securement of the base end 31 of arm 13 which will be discussed in more detail hereinafter. Atop the long end 32 of beam 26 is affixed a long yoke 33. Long yoke 33 comprises a pair of upward extending flanges 34 which are parallel, are separated by the width of the beam of about 0.50 inch, and extend upward about 6.25 inches. A series of horizontal apertures 35 are inscribed in each flange 34 of yoke 33, providing a multiplicity of horizontal straight paths through flanges 34, with varying elevations. These apertures 35 provide adjustable points of securement for a portion of arm 13 as will be discussed in more detail hereinafter.

Below the long end 32 of beam 26 is fixed at least one support roller 40 having an axis parallel to the longitudinal axis of the beam 26 and extending downward into rolling contact with the top of square drive plate 22, in such a manner that when drive shaft 24 rotates, beam 26 rotates end around end along the axis of drive shaft 24 in a substantially horizontal manner, supported near one end by shaft 24 and near the other end by roller 40 which rolls along plate 22 in a circular path.

Driving means 16 comprises primarily a motor 36. Motor 36 may be an electric motor with transmission gearing 37 to reduce the load on the motor 36 and a remote variable resistor 38 positioned in the power cord 39 to turn the motor 36 on and off and to control the speed of the motor 36. The motor 36 may, in the alternative, be an internal combustion engine with transmission gearing 37 and remote means such as 38 to start and stop the motor 36.

Arm 13 is semi-rigid with an overall length of about 48 inches. It is somewhat flexible so that it will bend under the combined weight of the line 14, the ball 15 and the arm 13; but it is sufficiently rigid to adequately maintain the predetermined alignment. The flexibility is needed to partially absorb the shock of the batting practice as will be discussed in more detail hereinafter. Referring now to FIG. 3, arm 13 comprises an outer, hard, tubular layer 41 of PVC or similar material and an elongated core 42 of solid nylon. The tubular outer layer may be separated into three separate linear sections 43, each having a length of about 16 inches. The core 42 may be separated into two core sections 44, each having a length of about 18 inches. Each outer section 43 has apertures 45 inscribed along a line passing through the center of the section 43, perpendicular to the longitudinal axis of the section 43; and each core section 44 has similar apertures 46 formed through its center, perpendicular to the longitudinal axis of the core section 43. To assemble the arm 13 and mount it into the rotatable arm bracket 25, a core section 44 is inserted into an outer section 43 and their apertures 45, 46 are aligned with the selected horizontal apertures 30 of the short yoke 28 flanges 29. A pin 47 or similar connector such as a bolt is passed through the apertures 30, 45 and 46 to secure the bottom of the arm 13 to the short yoke 28. To achieve proper angularity and elevation of arm 13, another set of apertures 45, 46 is aligned with a selected pair of horizontal apertures 35 of the flanges 34 of the long yoke 33 and a pin 47 or similar connector is passes through the apertures 35, 45, 46. A second outer section 43 is placed over the exposed portion of the first core section 44 and their apertures 45, 46 aligned and pins 47 placed therein as previously described. The third outer section 43 is also placed on the second core section 44 and secured as previously described, but the third outer section 43 has a compression spring 48 inserted as shown, near the end of the second core section 44 and has an end plug 49 with a central passageway having a diameter slightly larger than the diameter of the line 14. The line 14 passes through the plug 49 and the spring 48, and has a stop 50 at its inner end 51, which prevents the inner line end 51 from exiting through the spring 48 and the plug 49. The line 14 is about 42 inches in total length, about 12 inches with the arm 13 and about 30 inches exposed, and the ball 15 is permanently secured to the outer end of the line 52. Although arm 13 has flexibility as previously discussed, it is essential to the durability of the machine 10 that additional shock absorption be provided through the enclosed spring 48 arrangement as shown. When the machine 10 operates to swing the line 14 and the ball 15, the ball 15 travels along a general circular path to a batter using the machine 10 for batting practice. If the batter makes contact with the ball 15 during the swing of the bat, the ball 15 is usually violently hit into a direction opposite to its normal direction of travel, and as it proceeds on its hit path it takes the line 14 with it, removes all slack from the line 14 and continues to provide shock to the machine 10, which is absorbed primarily by the spring 48, and secondarily by the flexibility of arm 13.

Referring to FIG. 1, FIG. 2 and FIG. 3 it can be seen that, in addition to the components previously mentioned, the square drive plate 22 may have an enlarged, circular cam surface 52 inscribed in the top surface of the plate 22 which may cooperate with a horizontal roller 53 secured to the bottom of beam 26 to reduce stress on drive shaft 24.

Figure 4:
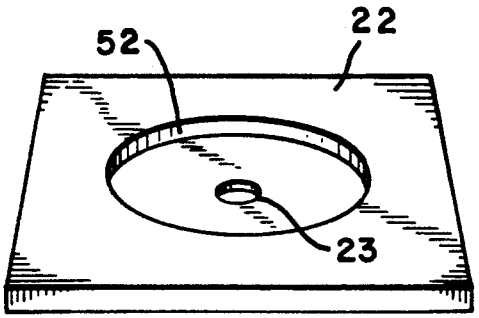
FIG. 4 is an elevation of a drive plate.
Figure 5:
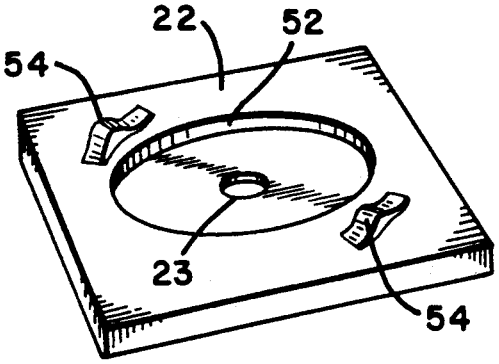
FIG. 5 is an elevation of an alternate drive plate.

Referring to FIG. 4 and FIG. 5, the square drive plate 22 may be flat as show in FIG. 4 or it may have irregularities 54 in the path of rotation of roller 40 as shown in FIG. 5. These irregularities 54 alter the generally horizontal path of ball 15 to make the ball 15 rise or fall in order to vary the presentation of the ball 15 to the batter.

While this invention has been described in detail with particular reference to a preferred embodiment thereof, it will be understood that variations and modifications can be effective within the spirit and scope of the invention as described hereinbefore and as defined in the appended claims. It is understood that the floor square as used may be used as a ceiling square, or wall square, or as a square for any other structural component which requires the markings discussed.

INDUSTRIAL APPLICABILITY

This invention is capable of exploitation in the sports equipment industry and is particularly useful in the batting practice equipment industry.

I claim:

1. A batting practice machine comprising:

a) a generally flat, horizontal base further comprising a flat bottom and a peripheral wall, defining a reservoir therein;

b) a vertical frame secured to said base, and extending upward therefrom;

c) an adjustable, rotatable, outward extending arm attached to said frame; said arm being semi-rigid with an overall length of about 48 inches and a diameter of about 0.50 inch, said arm further comprising a hard outer tubular layer having three separate linear sections each about 16 inches in length, and an elongated flexible core having two linear sections each about 18 inches in length, with at least two apertures inscribed through the diameter of said arm perpendicular to the longitudinal axis of said arm;

d) a flexible line secured at a first end thereof to said arm;

e) a ball secured to a second end of said line; and f) drive means secured to said frame and secured to said arm for rotating said arm in a generally horizontal circle.

2. The apparatus of claim 1 comprising a compression spring inserted in the outer end of said arm, and an end plug preventing said compression spring from exiting said arm.

3. The apparatus of claim 2 wherein said end plug has a central passageway having a diameter slightly larger than the diameter of said line; said first end of said line passes through said plug and said spring, stop means attached to said first end of said line and being within said tubular outer layer of said arm for preventing said first end from passing back through said plug and spring.

4. The apparatus of claim 3 wherein said line is about 42 inches in length, about 12 inches inside said arm and about 30 inches exposed.

* * * * *